US010453623B2

(12) United States Patent
Sano et al.

(10) Patent No.: US 10,453,623 B2
(45) Date of Patent: Oct. 22, 2019

(54) SWITCH FOR GAS INSULATED SWITCHGEAR, AND GAS INSULATED SWITCHING DEVICE

(71) Applicant: Mitsubishi Electric Corporation, Chiyoda-ku, Tokyo (JP)

(72) Inventors: Koji Sano, Tokyo (JP); Naoaki Inoue, Tokyo (JP); Masahiro Arioka, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 15/559,499

(22) PCT Filed: Nov. 30, 2015

(86) PCT No.: PCT/JP2015/083577
§ 371 (c)(1),
(2) Date: Sep. 19, 2017

(87) PCT Pub. No.: WO2016/199326
PCT Pub. Date: Dec. 15, 2016

(65) Prior Publication Data

US 2018/0122590 A1 May 3, 2018

(30) Foreign Application Priority Data

Jun. 10, 2015 (WO) ..... PCT/JP2015/066670

(51) Int. Cl.
*H01H 1/14* (2006.01)
*H01H 3/32* (2006.01)
(Continued)

(52) U.S. Cl.
CPC ..... *H01H 1/14* (2013.01); *H01H 3/32* (2013.01); *H01H 9/02* (2013.01); *H01H 9/30* (2013.01);
(Continued)

(58) Field of Classification Search
CPC ..... H01H 1/14; H01H 1/2041; H01H 1/42; H01H 3/32; H01H 9/02; H01H 9/30;
(Continued)

(56) References Cited

U.S. PATENT DOCUMENTS 2,954,449 A * 9/1960 Lindell ..... H01H 33/126 200/48 R
6,271,493 B1 * 8/2001 Ponsioen ..... H01H 1/52 218/22
(Continued)

FOREIGN PATENT DOCUMENTS

CN 103178465 A 6/2013
CN 203631403 * 6/2014 ..... H01H 31/32
(Continued)

OTHER PUBLICATIONS

Translation of CN203631403 (Original doc. published Jun. 4, 2014).*
(Continued)

*Primary Examiner* — Truc T Nguyen
*Assistant Examiner* — William A Bolton
(74) *Attorney, Agent, or Firm* — Buchanan Ingersoll & Rooney PC

(57) ABSTRACT

A switch includes: switch blades for multiple phases which perform three-position switching among ON, OFF, and ground, using a rotation shaft; and phase-to-phase connection mechanisms which support the switch blades for the phases so as to be insulated among the phases and against the ground, and which connect the switch blades for the
(Continued)

phases and cause them to cooperate with each other. The phase-to-phase connection mechanisms include fitting couplings made of an insulating material and each composed of a large-diameter endless frame body and a small-diameter endless frame body which are fitted to each other. The fitting couplings are arranged on the same axial line.

9 Claims, 10 Drawing Sheets

(51) Int. Cl.

| | |
|---|---|
| ***H01H 9/02*** | (2006.01) |
| ***H01H 9/30*** | (2006.01) |
| ***H01H 31/00*** | (2006.01) |
| ***H01H 31/28*** | (2006.01) |
| ***H01H 33/42*** | (2006.01) |
| ***H01H 1/42*** | (2006.01) |

(52) U.S. Cl.
CPC ..... *H01H 31/003* (2013.01); *H01H 31/28* (2013.01); *H01H 33/42* (2013.01); *H01H 2001/425* (2013.01); *H01H 2235/01* (2013.01)

(58) Field of Classification Search
CPC ..... H01H 33/42; H01H 33/64; H01H 33/182; H01H 31/02; H01H 31/28; H01H 31/32; H02B 13/035; H02B 13/075
USPC ..... 218/12–14, 55, 22, 79, 80, 100, 113; 200/50.34, 50.38, 50.39, 244
See application file for complete search history.

(56) References Cited

U.S. PATENT DOCUMENTS

| | | | | |
|---|---|---|---|---|
| 6,445,569 | B1 * | 9/2002 | Shichida | H02B 13/035 361/604 |
| 6,559,403 | B2 * | 5/2003 | Gutalj | H01H 31/003 218/79 |
| 8,263,890 | B2 * | 9/2012 | Endre | H01H 1/42 200/254 |
| 8,969,748 | B2 * | 3/2015 | Endre et al. | H01H 1/42 200/254 |
| 9,040,861 | B2 * | 5/2015 | Park | H01H 33/7084 218/26 |
| 2010/0014218 | A1 | 1/2010 | Mori et al. | |
| 2013/0153538 | A1 | 6/2013 | Park | |

FOREIGN PATENT DOCUMENTS

| | | | | |
|---|---|---|---|---|
| CN | 203631403 | U | 6/2014 | |
| DE | 19816592 | B4 | 4/2006 | |
| DE | 19857170 | B4 | 7/2009 | |
| EP | 1385243 | A2 * | 1/2004 | H02B 13/025 |
| EP | 2 608 240 | A1 | 6/2013 | |
| JP | S-5598110 | U | 7/1980 | |
| JP | H-0186029 | U | 6/1989 | |
| JP | H02-037435 | U | 3/1990 | |
| JP | H-0237435 | U | 3/1990 | |
| JP | 11-53998 | A | 2/1999 | |
| JP | 2010-27226 | A | 2/2010 | |
| JP | 2013-5505 | A | 1/2013 | |
| KR | 200433268 | Y1 | 12/2006 | |
| KR | 101250261 | B1 | 4/2013 | |
| WO | WO 2015/190500 | A1 | 12/2015 | |

OTHER PUBLICATIONS

International Search Report (PCT/ISA/210) dated Feb. 16, 2016, by the Japanese Patent Office as the International Searching Authority for International Application No. PCT/JP2015/083577.
Written Opinion (PCT/ISA/237) dated Feb. 16, 2016, by the Japanese Patent Office as the International Searching Authority for International Application No. PCT/JP2015/083577.
Office Action (Notifiation of Reason for Refusal) dated Jun. 27, 2018, by the Korean Intellectual Property Office in corresponding Korean Patent Application No. 10-2017-7033632, and an English Translation of the Office Action. (9 pages).
Office Action dated Sep. 3, 2018, by the Chinese Patent Office in corresponding Chinese Patent Application No. 201580080563.9 and English translation of the Office Action. (16 pages).
Extended European Search Report dated Oct. 29, 2018, issued by the European Patent Office in corresponding European Application No. 15895010.5. (7 pages).
Office Action dated Apr. 12, 2019, by the Chinese Patent Office in corresponding Chinese Patent Application No. 201580080563.9 and English translation of the Office Action. (16 pages).
Office Action dated Jul. 15, 2019, by the Chinese Patent Office in corresponding Chinese Patent Application No. 201580080563.9 and English translation of the Office Action. (17 pages).

* cited by examiner

SWITCH FOR GAS INSULATED SWITCHGEAR, AND GAS INSULATED SWITCHING DEVICE

TECHNICAL FIELD

The present invention relates to a switch, and relates to a switch for gas insulated switchgear and a gas insulated switching device including a three-position switch which enables selection of switch stages of ON, OFF, and ground and which is provided in a sealed compartment in which an insulation gas is sealed.

BACKGROUND ART

As conventional three-position switches, Patent Document 1 proposes a structure in which, when an insulated connection rod attached to blades for three phases is moved approximately horizontally, each blade rotates to move in an arc shape to a position of ON, OFF, or ground, and Patent Document 2 proposes a structure in which a movable contactor and a fixation contactor are provided at both ends of a vacuum valve, the fixation contactors for three phases are connected in an insulated manner, a movable portion including the vacuum valve rotates about each fixation contactor, and a rotation shaft of the movable portion and a connection driving portion are directed in the same direction.

CITATION LIST

Patent Document

Patent Document 1: German Patent No. 19816592B4
Patent Document 2: German Patent No. 19857170B4

SUMMARY OF THE INVENTION

Problems to be Solved by the Invention

In a switch tank which is one of components of a gas insulated switchgear, since an insulation gas is sealed therein, the entire tank size can be downsized by reducing the arrangement of main circuit conductors. However, multiple insulating parts, bolts, pins, and the like are used for configuring a mechanism for transferring a drive force to an adjacent phase, and therefore there is a disadvantage that it is difficult to perform an assembly work for attaching and connecting those parts in a sealed compartment partitioned in a small size and many work steps are needed.

In the switch tank, a configuration in which switch blades for switching among ON, OFF, and ground through rotational operation are arranged for three phases in a coaxial straight line, contributes to reduction in tank width. However, there is a technical difficulty in an engagement structure and a drive force transfer structure of an insulated mechanism portion that gives a rotational drive force to the blades for three phases while ensuring insulation among phases and from the ground in a narrow space.

An object of the present invention is to obtain a switch for gas insulated switchgear and a gas insulated switching device that enable reduction in the number of components and improvement in assembly performance.

Solution to the Problems

A switch for gas insulated switchgear according to the present invention includes: switch blades for multiple phases which perform three-position switching among ON, OFF, and ground, using a rotation shaft; and phase-to-phase connection mechanisms made of an insulating material, which support the switch blades for the phases and which connect the switch blades for the phases and cause them to cooperate with each other. The phase-to-phase connection mechanisms include fitting couplings each composed of a large-diameter endless frame body and a small-diameter endless frame body which are fitted to each other. The fitting couplings are arranged on the same axial line.

Effect of the Invention

In the switch for gas insulated switchgear according to the present invention, attachment and connection works for main circuit parts using pins, bolts, and the like in a sealed compartment partitioned in a small size, can be decreased. Therefore, the assembly work is facilitated, the number of components can be decreased, and the number of assembly work steps can be decreased, whereby an effect of reducing the cost for manufacturing a gas insulated switchgear is obtained. In addition, without using pins, bolts, and the like for a connection part between a main circuit portion and an operation mechanism portion and a connection part between adjacent phases, the phase-to-phase connection mechanisms are connected to each other using fitting couplings. Thus, it is possible to provide a gas insulated switchgear that enables assembly work to be easily performed without using assembly work tools, and enables device size reduction by reducing the size of a switch tank.

BRIEF DESCRIPTION OF THE DRAWINGS

FIGS. 1A to 1C show the entire configuration of a gas insulated switchgear according to embodiment 1 of the present invention, in which FIG. 1A is a side sectional view, FIG. 1B is a front sectional view as seen from a B-B arrow direction in FIG. 1A, and FIG. 1C is a plan view as seen from an A-A arrow direction in FIG. 1A.

FIGS. 2A to 2D are views showing the internal structure of a switch tank of the gas insulated switchgear according to embodiment 1 of the present invention, in which FIG. 2A is a front sectional view, FIG. 2B is a side sectional view, FIG. 2C is a plan view as seen from a C-C arrow direction in FIG. 2A, and FIG. 2D is a front sectional view as seen from a B-B arrow direction in FIG. 2B.

FIGS. 3A to 3C are front views showing the respective operation states, "ON", "OFF", and "ground", of a switch blade 12 in FIG. 2A, in which FIG. 3A shows an ON state of the switch blade, FIG. 3B shows an OFF state of the switch blade, and FIG. 3C shows a ground state of the switch blade.

FIGS. 4A and 4B show phase-to-phase connection mechanisms 13 supporting the switch blades 12 according to embodiment 1 of the present invention, in which FIG. 4A is a perspective exploded view and FIG. 4B is a perspective view in an assembled state.

FIGS. 5A to 5E show a connection adapter 14 and a seal shaft 16 of the phase-to-phase connection mechanism according to embodiment 1 of the present invention, in which FIG. 5A is a front view of the connection adapter 14, FIG. 5B is a side sectional view along a center line of the connection adapter 14, FIG. 5C is a back view of the connection adapter 14, FIG. 5D is a sectional view showing an attachment configuration of the connection adapter 14, a seal case 15, and the seal shaft 16 at a tank wall penetrating portion of the switch tank 2, and FIG. 5E is a front view as seen from an X-X direction in FIG. 5D when the tank wall is removed.

FIGS. 6A to 6I show a phase-to-phase connection mechanism 18 supporting the switch blades 12 according to embodiment 2 of the present invention, in which FIG. 6A is a left side view, FIG. 6B is a front view, FIG. 6C is a back view, FIG. 6D is a sectional view as seen from a D-D arrow direction in FIG. 6A, FIG. 6E is a sectional view as seen from an E-E arrow direction in FIG. 6B, FIG. 6F is a sectional view along an F-F line positioned on the central axis of a pin 17*a* in FIG. 6A as seen from the F-F arrow direction, FIG. 6G is a plan sectional view as seen from a Y-Y direction in FIG. 6E, FIG. 6H is a front view of the switch blade 12 shown in FIG. 6E, and FIG. 6I is a right side view of FIG. 6H.

FIGS. 7A and 7B are views showing the internal structure of a switch tank of a gas insulated switchgear according to embodiment 2 of the present invention, in which FIG. 7A is a right side view and FIG. 7B is a sectional view as seen from a G-G arrow direction in FIG. 7A.

FIGS. 9A to 9C show a connection adapter 14 according to embodiment 2 of the present invention, in which FIG. 9A is a front view of the connection adapter 14, FIG. 9B is a side sectional view along a center line of the connection adapter 14, and FIG. 9C is a back view of the connection adapter 14.

DESCRIPTION OF EMBODIMENTS

Figure 1A:
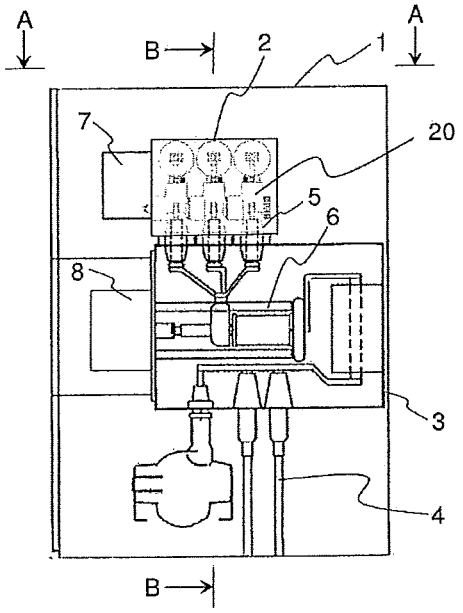

Hereinafter, embodiments of the present invention will be described with reference to the drawings.

In the drawings, the same reference character denotes the same or corresponding part.

Embodiment 1

A gas insulated switchgear according to embodiment 1 will be described with reference to FIGS. 1A to 5E.

Figure 1B:
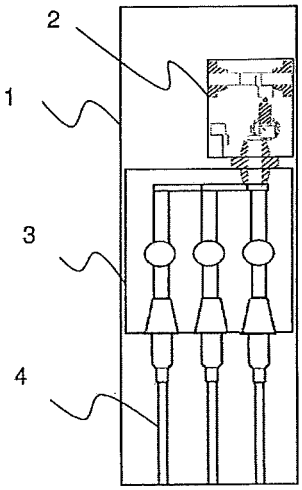
Figure 1C:
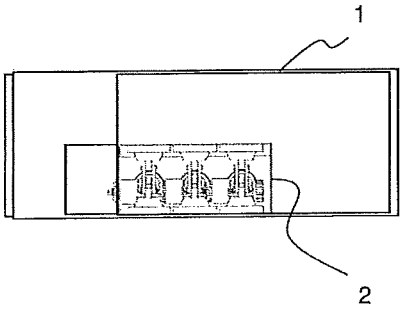
Figure 2A:
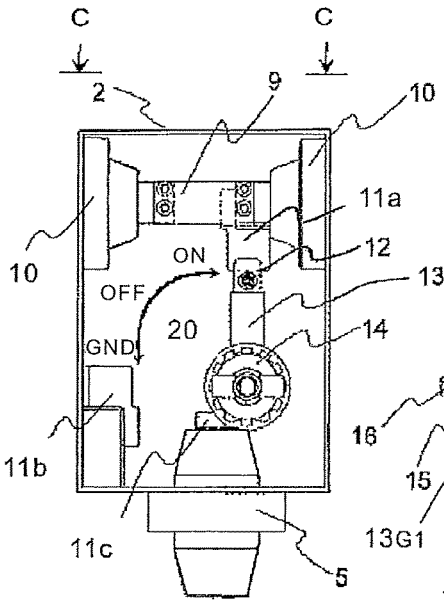
Figure 2B:
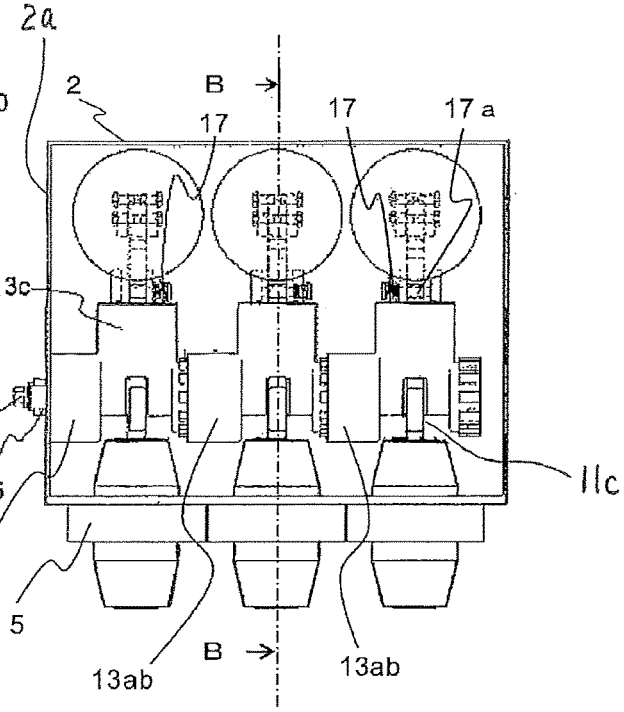
Figure 2C:
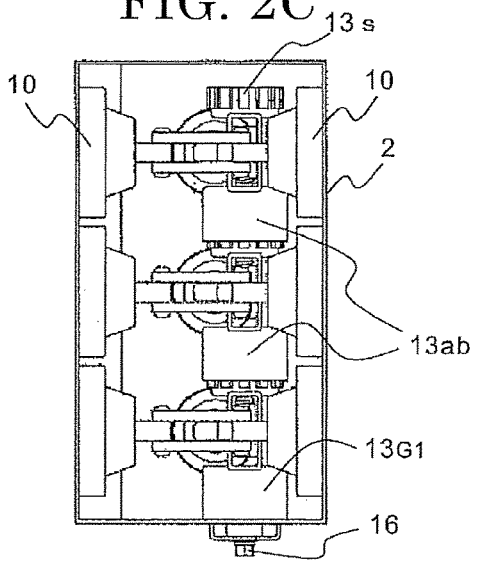
Figure 2D:
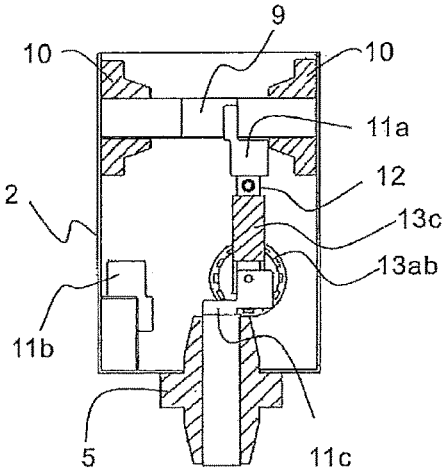

The gas insulated switchgear 1 having an entire configuration shown in FIGS. 1A to 1C includes: a circuit breaker tank (first sealed compartment) 3 storing a circuit breaker 6; a circuit breaker operation mechanism 8 for performing operation of the circuit breaker 6; a switch tank (second sealed compartment) 2 storing a switch 20 and a horizontal bus 9; a switch operation mechanism 7 for performing operation of the switch 20; a power cable 4 for receiving power from a power system or feeding power to a load; and the like.

In the case where the gas insulated switchgear is used for power feeding, power is received from the bus, and the power is fed through the switch 20, a compartment bushing 5, and then the circuit breaker 6, to the power cable 4 connected to a load. It is noted that, in the circuit breaker tank 3, an insulation gas such as SF6 gas or dry air is sealed, whereby the stored devices and a main circuit conductor are insulated.

FIGS. 2A to 2D show the internal structure of the switch tank 2 of the gas insulated switchgear 1 shown in FIGS. 1A to 1C. Via the compartment bushing 5 attached so as to penetrate in an airtight manner from the circuit breaker tank 3 to the switch tank 2, the switch 20 in the switch tank is connected to bus bushings 10 through a compartment-bushing-side fixed terminal 11*c*, the switch blade 12, and then an ON-side fixed terminal 11*a*, and feeds power to the bus. The bus bushing 10 and the bus bushing 10 are connected by the horizontal bus 9. Regarding ground of the switch 20, a load-side circuit is grounded when the switch blade 12 bites into a ground-side fixed terminal 11*b* fixed to the switch tank 2. It is noted that 17 denotes contact pressure springs for applying loads to contact portions on both sides (rotation shaft side, and contact portion side in contact with the above other terminal) of the switch blade 12, and the contact pressure springs 17 are each fastened by a pin 17*a*.

Figures 3A, 3B, 3C:
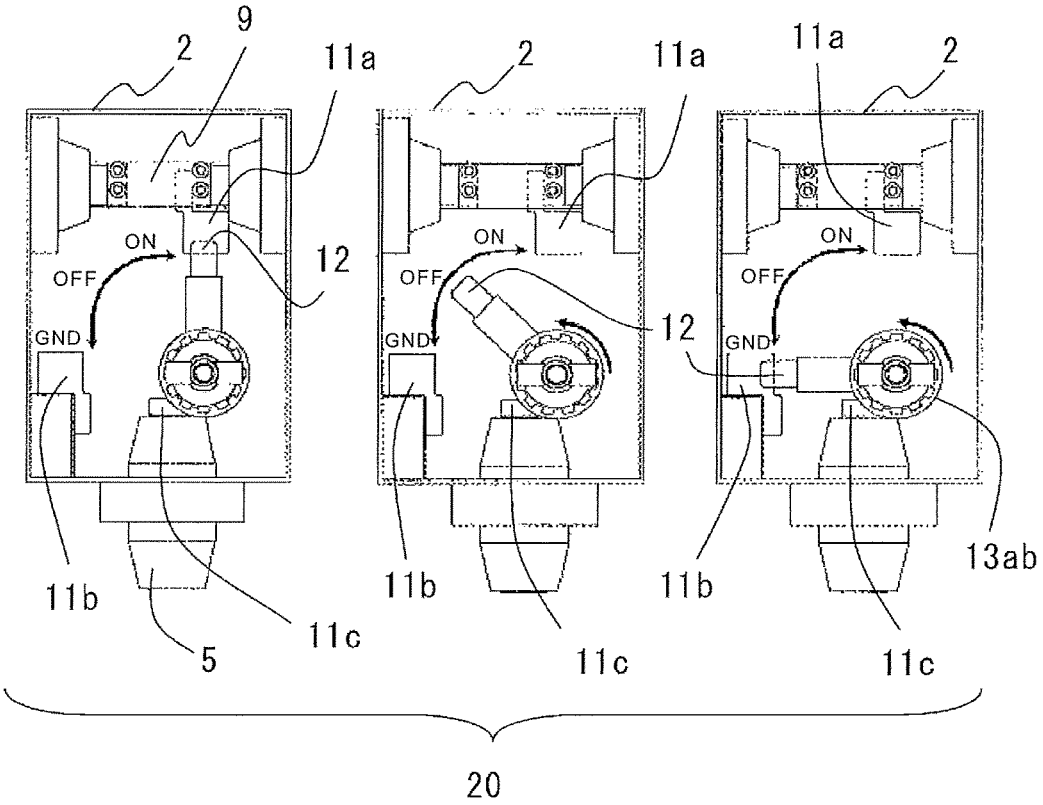

FIGS. 3A to 3C show operation states of the switch 20. The switch 20 has the switch blades 12 for three phases. By a drive force being transferred from the switch operation mechanism 7 by leftward rotation as seen from the front, each switch blade 12 is brought into any of three-position switching states, i.e., ON position in FIG. 3A, OFF position (disconnection position) in FIG. 3B, and ground position in FIG. 3C.

The switch blades 12 for respective phases are supported by phase-to-phase connection mechanisms 13 having a configuration shown in detail in FIGS. 4A and 4B, and the phase-to-phase connection mechanisms 13 connect the switch blades for respective phases and cause them to cooperate with each other as described later.

Figure 4A:
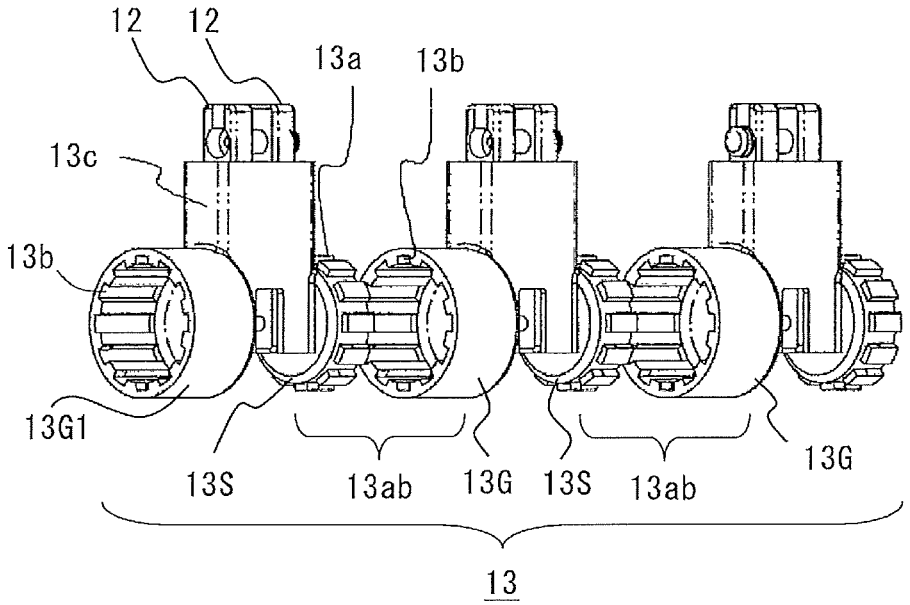
Figure 4B:
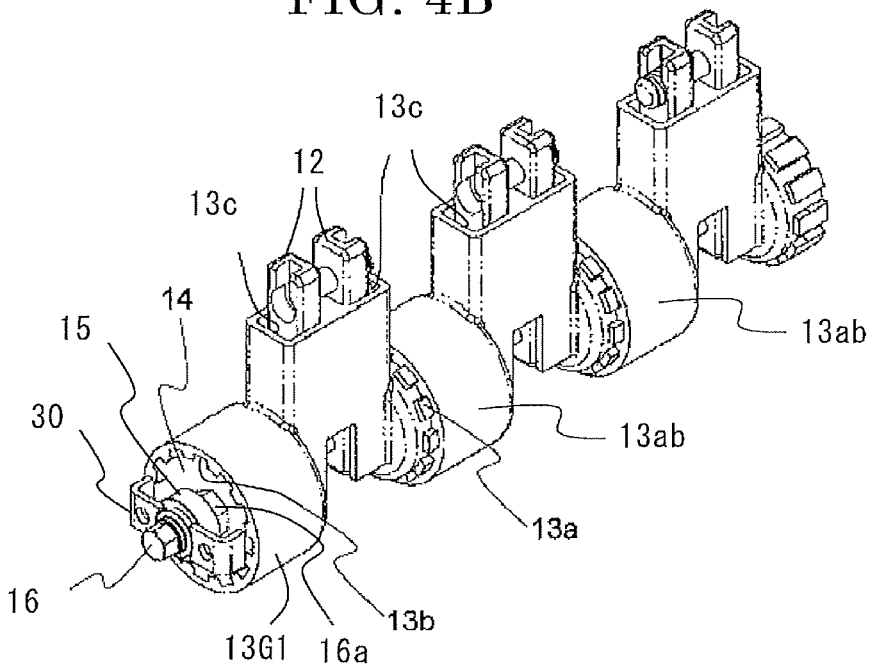

FIGS. 4A and 4B show the phase-to-phase connection mechanisms 13 supporting the switch blades 12, and in this example, three phase-to-phase connection mechanisms 13 are connected for three phases.

The phase-to-phase connection mechanisms 13 include: box-shaped blade support portions 13*c* which support the switch blades 12 and which have a quadrangular cross section and are made of an insulating material; and fitting couplings 13*ab* which are made of an insulating material and serve also as blade rotation shafts of the switch blades 12. As shown in FIGS. 4A and 4B, each blade support portion 13*c* has a quadrangular box shape, stores the switch blade 12 in this box, and covers the outer periphery of the switch blade 12 except for its end contact portion which is contactable with and separable from the ON-side fixed terminal 11*a* or the ground-side fixed terminal 11*b*. That is, the blade support portion 13*c* surrounds and holds the switch blade 12 such that only the end contact portion of the switch blade 12 protrudes from the end of the box-shaped blade support portion 13*c*.

The width of the blade support portion 13*c* in the phase-to-phase direction of the main circuit is set to be greater than the attachment width of the contact pressure spring 17 and the pin 17*a* (i.e., a charge portion of the switch blade 12) attached to the switch blade 12. Therefore, in the attachment part of the contact pressure spring 17 and the pin 17*a*, an electric field between the main circuit phases or with respect to the ground can be relaxed, whereby insulation of the switch blades 12 among phases or from the ground can be enhanced.

In addition, the fitting coupling 13*ab* is used for transferring, to an adjacent phase, a drive force transferred through a connection adapter 14 (described later) from a seal shaft 16 (described later) connected to the switch operation mechanism 7.

The fitting coupling 13*ab* is composed of: a cup-shaped small-diameter endless frame portion 13S having a plurality of projecting portions 13*a* on the outer circumferential surface thereof and protruding in a blade rotation shaft direction; and a cup-shaped large-diameter endless frame portion 13G having a plurality of recessed portions 13*b* in the inner circumferential surface thereof and protruding in the blade rotation shaft direction, and the small-diameter endless frame portion 13S and the large-diameter endless frame portion 13G are arranged in directions opposite to each other on the same axial line.

The fitting coupling 13*ab* is formed by fitting the projecting portions 13*a* and the recessed portions 13*b* to each other, and functions as a rotation shaft portion of the switch blade 12 as described above. It is noted that the fitting coupling 13*ab* is contactable and separable by the projecting portions 13*a* and the recessed portions 13*b* being slid in the rotation shaft direction, and is connected by the projecting portions 13*a* and the recessed portions 13*b* being engaged with each other.

The thicknesses, the numbers, and the shapes of the projecting portions 13*a* and the recessed portions 13*b* are determined so as to obtain a necessary torsional strength, on the basis of loads when the switch blade 12 is joined to the ON-side fixed terminal 11*a* or the ground-side fixed terminal 11*b*. In the drawings, the division numbers of the projecting portions 13*a* and the recessed portions 13*b* are twelve, but are not limited thereto. It is noted that, normally, the numbers of the projecting portions 13*a* and the recessed portions 13*b* are set to be equal to each other in terms of operation.

It is noted that each member (13*ab*, 13*a*, 13*b*, 13*c*, 13G, 13S) composing the phase-to-phase connection mechanism 13 is formed of an insulating material, and as the insulating material, a thermoplastic resin (polybutylene terephthalate [PBT], polyethylene, polypropylene, etc.) or a thermosetting resin (such as epoxy) is used.

Thus, the blade support portion 13*c* functions as an insulating barrier among phases and against the ground.

A mechanism for connection of the phase-to-phase connection mechanism 13 to the switch operation mechanism 7 is composed of: a metallic gear-shaped connection adapter 14 to be engaged (fitted) with the recessed portions 13*b* of the large-diameter endless frame portion 13G of the phase-to-phase connection mechanism 13; a seal case 15 having contact with outside while ensuring airtightness between inside and outside of the sealed compartment; the seal shaft 16; a holder metal member 30; and other members. The configuration of this mechanism will be described in detail with reference to FIGS. 5A to 5E.

Figure 5A:
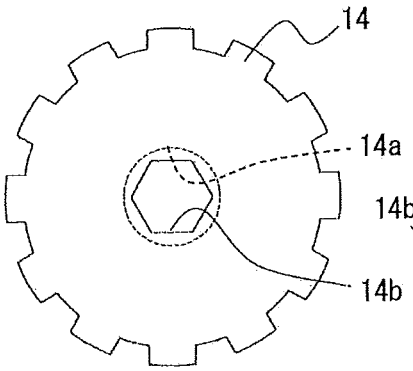
Figure 5B:
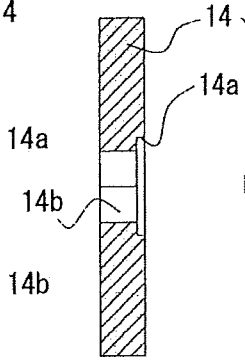
Figure 5C:
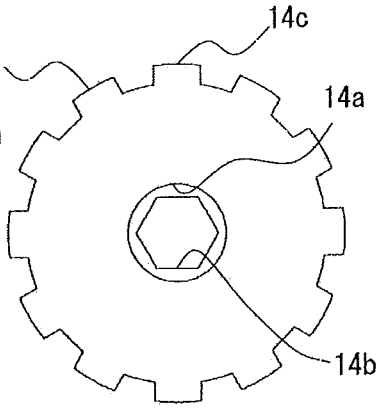
Figure 5E:
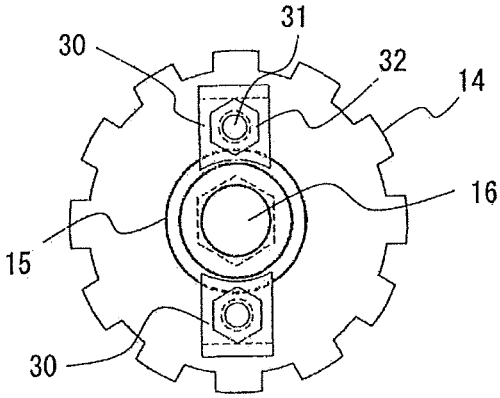
Figure 5D:
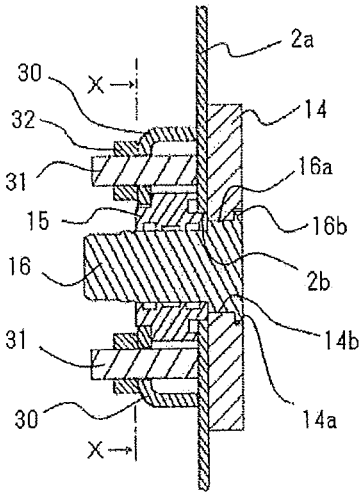

As shown in FIG. 5D, the connection mechanism forms a penetrating portion of the tank wall 2*a* of the switch tank 2.

As shown in FIGS. 5A to 5C, the connection adapter 14 has a counterbore portion 14*a* and a hexagonal through hole 14*b*. The seal shaft 16 has, at an inner end, a flange-shaped large-diameter part 16*b* to be fitted to the counterbore portion 14*a*, and has, on the inner side of the large-diameter part 16*b*, a hexagonal-bar-shaped engagement portion 16*a* to be inserted into the hexagonal through hole 14*b*.

By the above configuration, a rotational driving torque from the seal shaft 16 is transferred to the connection adapter 14 via the hexagonal through hole 14*b* and the hexagonal-bar-shaped engagement portion 16*a*, and further, since teeth 14*c* on the outer circumference of the connection adapter 14 are engaged with the recessed portions 13*b* of the phase-to-phase connection mechanism 13, the drive force from the connection adapter 14 is transferred to the phase-to-phase connection mechanism 13, and then, by the phase-to-phase connection mechanism 13 being driven, the switch 20 is operated to be opened or closed.

The seal case 15 is attached coaxially to the outer circumference of the seal shaft 16 penetrating the tank wall, the end portion of the seal shaft 16 is formed in a hexagonal-bar shape, and the seal shaft 16 is fitted to a drive shaft (not shown) of the switch operation mechanism 7, whereby a driving torque is transferred to the seal shaft 16. The outer circumferential surface, of the seal shaft 16, to which the seal case 15 is attached is formed in a smooth cylindrical shape, and slides on and contacts with a plurality of seal members (not shown) such as O rings provided in seal grooves formed in a recessed shape in the inner circumferential surface of the seal case 15, thereby keeping airtightness. In addition, a seal groove having a recessed shape is also formed in the attachment surface of the seal case 15 that contacts with the tank wall surface, whereby airtightness is kept between the tank wall and a seal member (not shown) such as an O ring provided in the seal groove. On the outer surface of the tank wall 2*a*, two studs 31 having axes parallel with the axis of the through hole are welded at positions separated from each other by a predetermined distance on opposite sides of the through hole 2*b* of the tank wall 2*a* as seen from the front side of the gas insulated switchgear 1. A male thread is formed around the outer circumference of each stud 31, and a holder metal member 30 formed in an L shape is fastened to each stud 31 by a nut 32. Then, ends of the L-shaped holder metal members press the seal case 15 to the tank wall side, thereby keeping airtightness of the tank wall penetrating portion.

As described above, in the phase-to-phase connection mechanism 13, connection to an adjacent phase is made by engagement of the projecting portions 13*a* and the recessed portions 13*b*, and as shown in FIGS. 4A and 4B, the phase-to-phase connection mechanisms 13 are sequentially combined from the left one (first), followed by the central one, and then the right one, and the shape for the engagement is cylindrical in the present embodiment 1. However, the engagement may be achieved by combination of polygonal shapes such as triangular shapes. In the case of polygonal shapes, it is not necessary to provide projection-recess shapes, and any polygonal shapes may be employed as long as projections and recesses of the polygonal shapes themselves are engaged with each other.

In addition, since the tank wall penetrating portion of the switch tank 2 has an airtight configuration as described above, it is possible to obtain a simplified airtight structure, and thus it is possible to obtain a small-sized gas insulated switchgear that can be easily manufactured.

As described above, according to the present embodiment 1, in configuring an insulated mechanism for transferring a drive force to an adjacent phase, the function thereof can be achieved by engagement of recesses and projections which are shapes provided to the phase-to-phase connection mechanism 13. Therefore, an effect of enabling reduction in the number of components is obtained. In addition, since the charge portion such as the blade is insulated by the phase-to-phase connection mechanism 13 as a barrier, the distance for insulation among phases and from the ground can be shortened, whereby an effect of enabling size reduction in the switch tank is also obtained.

Embodiment 2

A gas insulated switchgear according to embodiment 2 will be described with reference to FIGS. 6A to 9C.

In embodiment 2, a phase-to-phase connection mechanism 18 for supporting the switch blades 12 has a current route in which current from the compartment-bushing-side fixed terminal 11*c* flows to be divided into two switch blades 12, and has a structure in which loads are applied to conductor contact portions on the fixed side and the movable side by pin-coupling between the contact pressure springs 17 and the pins 17*a*.

The phase-to-phase connection mechanism 18 for supporting the switch blades 12 is composed of: a box-shaped blade support portion 18*e* supporting the switch blades 12 and having a quadrangular cross section; and a fitting coupling 18*ab* serving also as a blade rotation shaft of the switch blades 12. As in embodiment 1, the fitting coupling 18*ab* is used for transferring, to an adjacent phase, a drive force from the seal shaft 16 connected to the switch operation mechanism 7.

Figure 8:
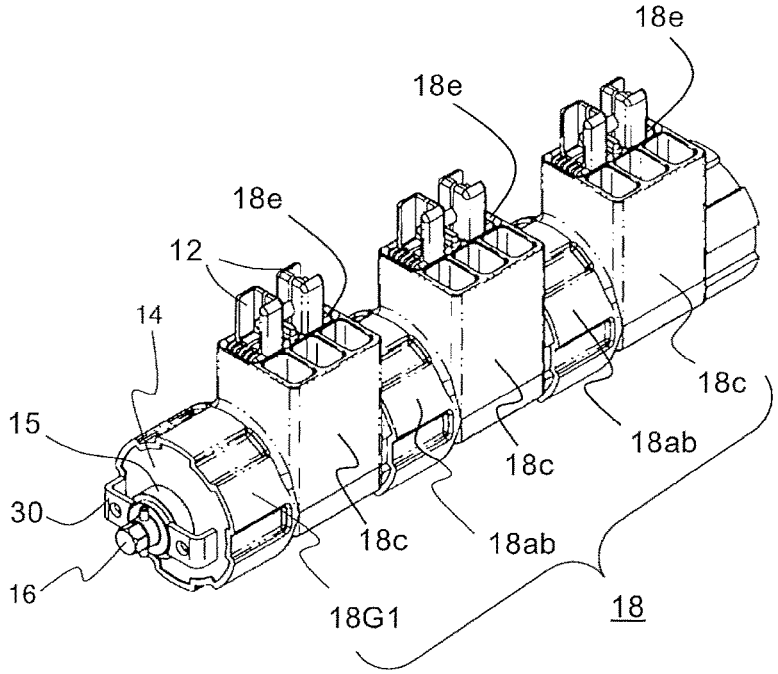
FIG. 8 is a perspective view showing an assembled state of the phase-to-phase connection mechanisms 18 supporting the switch blades 12 according to embodiment 2 of the present invention.
Figures 9A, 9B, 9C:
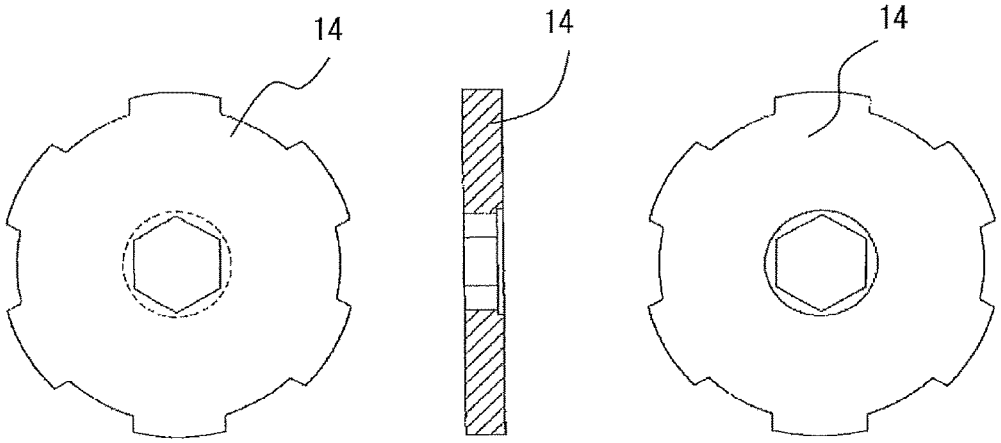

It is noted that a mechanism for connection of the phase-to-phase connection mechanism 18 to the switch operation mechanism 7 is composed of: a metallic connection adapter 14 (FIGS. 9A to 9C) to be engaged (fitted) with recessed portions 18*b* of a large-diameter endless frame portion 18G of the phase-to-phase connection mechanism 18; the seal case 15 having contact with outside while ensuring airtightness between inside and outside of the switch tank 2 (sealed compartment); the seal shaft 16; and the like, as shown in FIG. 8.

The fitting coupling 18*ab* is composed of: a cup-shaped small-diameter endless frame portion 18S having projecting portions 18*a* on the outer circumferential surface thereof and protruding in a blade rotation shaft direction; and a cup-shaped large-diameter endless frame portion 18G having recessed portions 18*b* in the inner circumferential surface thereof and protruding in the blade rotation shaft direction, and the small-diameter endless frame portion 18S and the large-diameter endless frame portion 18G are arranged in directions opposite to each other on the same axial line.

The fitting coupling is formed by fitting the projecting portions 18*a* and the recessed portions 18*b* to each other, and functions as a rotation shaft portion of the switch blade 12 as described above. It is noted that the fitting coupling 18*ab* is separably connected by the projecting portions 18*a* and the recessed portions 18*b*. In embodiment 2, the case where the division number of the recess-projection shape is six is shown.

Figure 6A:
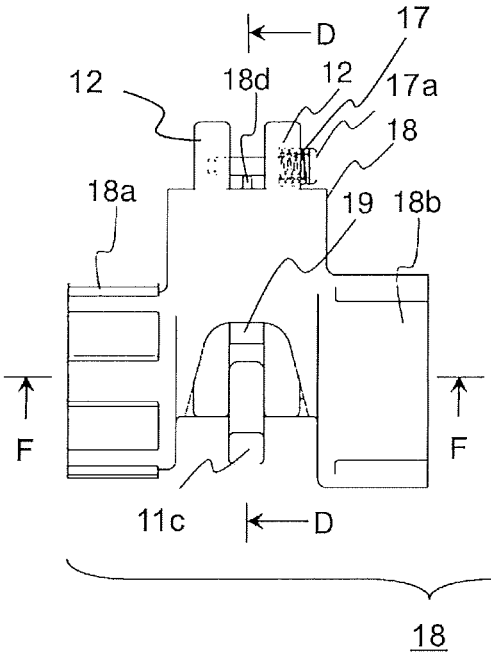
Figure 6B:
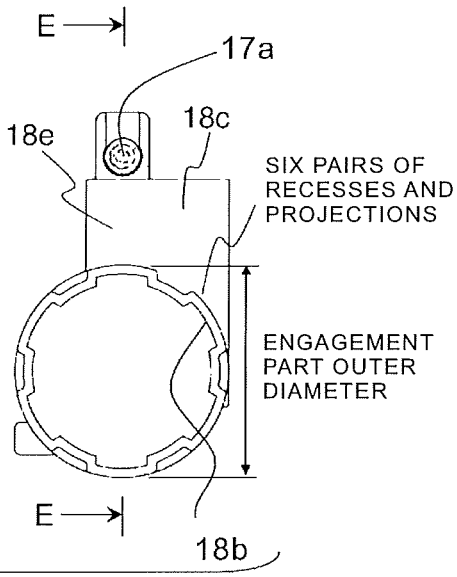
Figure 6C:
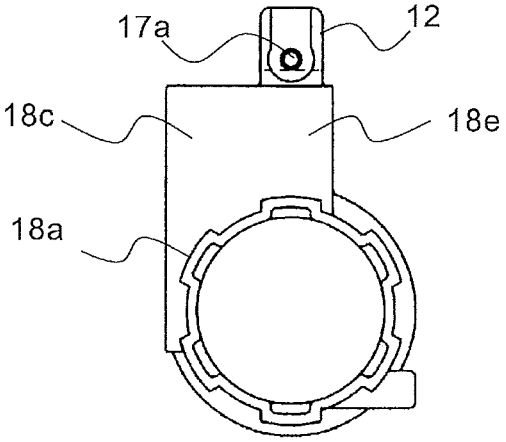
Figure 6D:
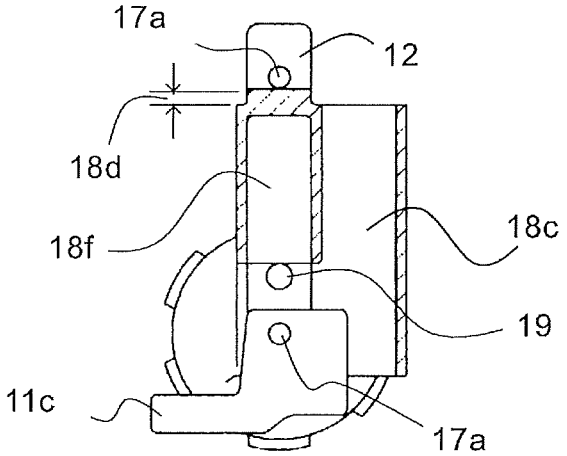
Figure 6E:
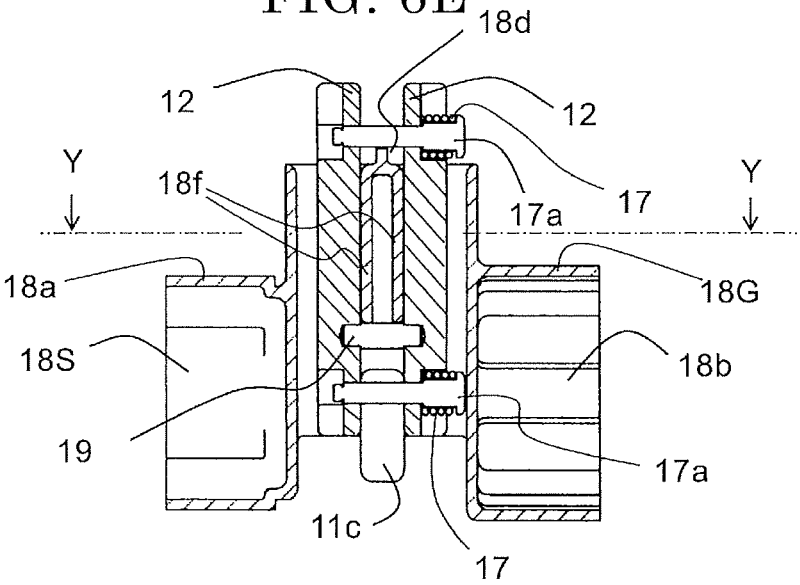
Figure 6F:
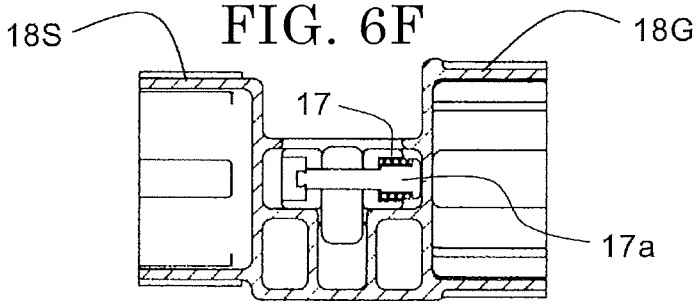

In the case where the phase-to-phase connection mechanism 18 is formed by a thin structure like a molded product, a stress occurring at a cutout portion due to part-to-part interference can be reduced by attaching a reinforcing rib 18*c* as shown in FIG. 6D. Regarding positioning in the height direction (longitudinal direction of blade) of the phase-to-phase connection mechanism 18, as shown in FIG. 6D and FIG. 6E, abutting portions of a positioning pin 19 attached between two switch blades 12 and a lower end of an inner partition wall 18*f* of the phase-to-phase connection mechanism 18 are brought into contact with each other, and abutting portions of an upper end of an upper rib 18*d* (protrusion) of the phase-to-phase connection mechanism 18 and a lower-side circumferential surface of the pin 17*a* on the end side of the switch blade 12 are brought into contact with each other, whereby movement of the phase-to-phase connection mechanism 18 in the longitudinal direction of the blade is suppressed, and thus, the phase-to-phase connection mechanism 18 is kept at a predetermined position without moving in the longitudinal direction of the blade even when the phase-to-phase connection mechanism 18 is rotationally operated.

It is noted that a hole 12*b* for the positioning pin 19, formed in the switch blade 12 is a blind hole not penetrating the switch blade 12. The positioning pin 19 is held at a predetermined position between two switch blades 12. It is noted that holes 12*a*, 12*c* are holes for pins.

It is noted that each member (18*ab*, 18*a*, 18*b*, 18*c*, 18*d*, 18*e*, 18*f*) composing the phase-to-phase connection mechanism 18 is formed of an insulating material. As the insulating material, a thermoplastic resin (polybutylene terephthalate [PBT], polyethylene, polypropylene, etc.) or a thermosetting resin (such as epoxy) is used.

In the phase-to-phase connection mechanism 18, if the outer diameter (radius) of the projecting portions 18*a* and the recessed portions 18*b* is increased, a load torque occurring when the switch blade 12 bites into the fixed-side terminal (ON-side fixed terminal 11*a*, ground-side fixed terminal lib) is divided by the increased radius, whereby a load applied to the engagement part is reduced, and thus a stress occurring on this part can be reduced.

Further, in the phase-to-phase connection mechanism 18, if an overlap length L (FIG. 7A) of the recess-projection engagement part is increased, a load on the engagement portion given from a load torque occurring when the switch blade 12 bites into the fixed-side terminal, and the contact area at the engagement part, are increased, whereby the surface pressure can be reduced.

Due to backlash of the fitting coupling 18*ab* of the phase-to-phase connection mechanism 18, an angle displacement occurs to an adjacent phase, and therefore the operation necessarily starts from the side close to the operation mechanism. Thus, when a load force is high at the time of biting into the fixed terminal in ON operation and at the time of starting OFF operation, the peak of the load force can be dispersed.

Figure 7B:
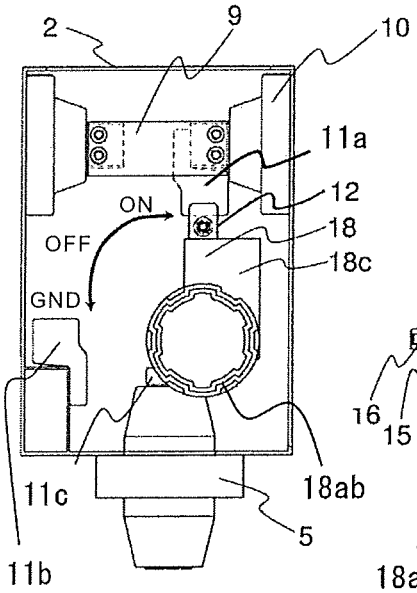
Figure 7A:
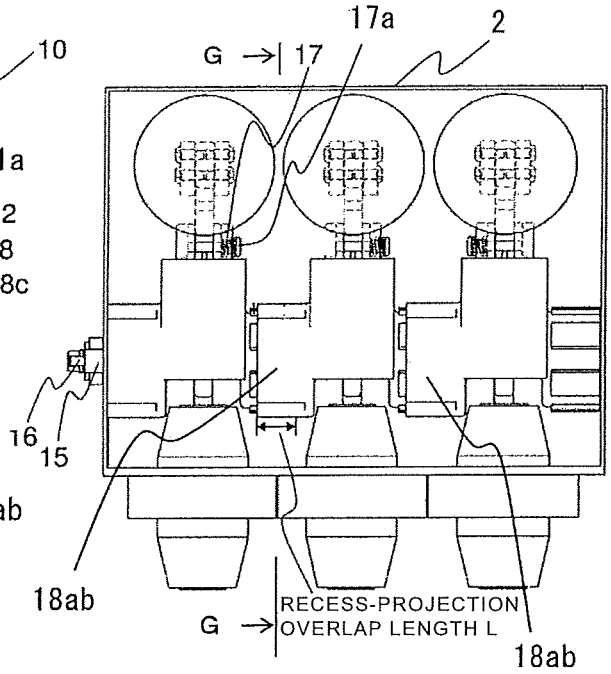

In FIGS. 7A and 7B, the phase-to-phase connection mechanisms 18 are incorporated into the switch tank 2 shown in FIGS. 2A to 2D (embodiment 1), and the recess-projection overlap length is set to be great, whereby a stress on the recess-projection engagement part can be reduced against the maximum load at the time of biting of the switch blade 12.

In FIG. 8, in the box-shaped blade support portion 18*e* having a quadrangular cross section of the phase-to-phase connection mechanism 18, two switch blades 12 are mounted as shown in FIG. 6E. In assembling of the switch blades 12, first, the pin 17*a* equipped with the contact pressure spring 17 and inserted into a base-end-side hole of the switch blade 12 is inserted into a blade attachment hole (not shown) of the compartment-bushing-side fixed terminal 11*c*, whereby the switch blades 12 are attached in a rotatable manner (FIG. 6E). At this time, the positioning pin 19 is also provided so as to be held between the two switch blades 12.

Figure 6G:
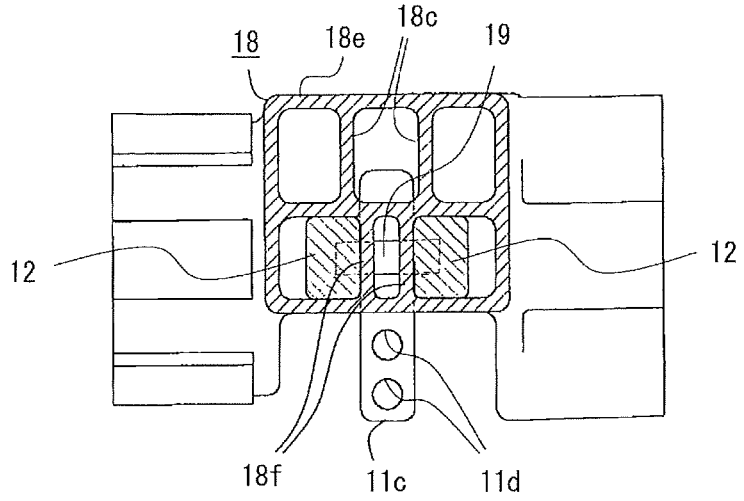
Figure 6H:
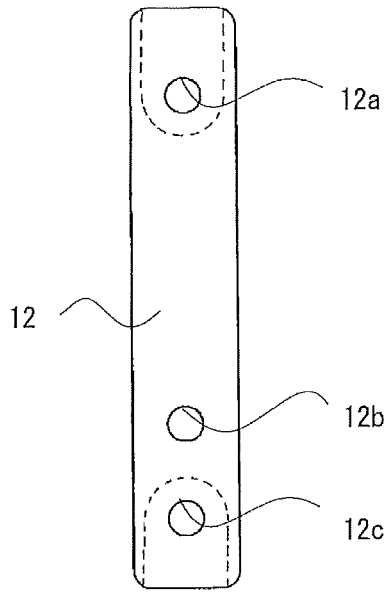
Figure 6I:
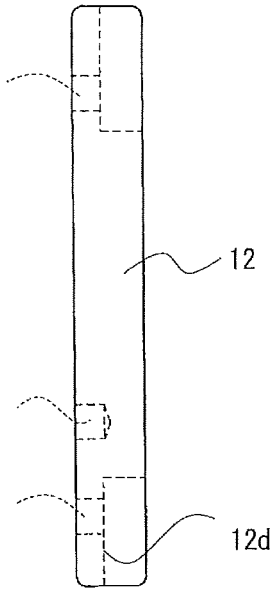

Next, the switch blades 12 are inserted into the box-shaped blade support portion 18*e* having a quadrangular cross section of the phase-to-phase connection mechanism 18, such that the inner partition wall 18*f* is sandwiched therebetween (FIG. 6G). The switch blades 12 are inserted to a position where the head ends of the switch blades 12 protrude from an end of the blade support portion 18*e*, and then the pin 17*a* equipped with the contact pressure spring 17 is inserted into head-end-side holes of the two switch blades 12, whereby assembly of the two switch blades 12 is completed. Thereafter, a connection portion protruding leftward from the compartment-bushing-side fixed terminal 11*c* shown in FIG. 6D is brought into contact with an end of a penetrating conductor (not shown) of the compartment bushing 5 shown in FIG. 7B and FIG. 2D, and they are connected by, for example, screwing bolts into attachment holes 11*d* of the compartment-bushing-side fixed terminal 11*c* shown in FIG. 6G. Assembly of the three-position switch is thus performed.

As described above, according to embodiment 2, an effect of decreasing the number of components and an effect of downsizing the switch tank are obtained as in embodiment 1.

Further, the reinforcing rib 18*c* of the phase-to-phase connection mechanism 18 is provided on one side or right-left symmetrically as shown in FIG. 6G, whereby a function of reinforcing the quadrangular box-shaped blade support portion 18*e* surrounding the switch blades is obtained, and thus an effect of increasing a torsional strength with which the phase-to-phase connection mechanism 18 can withstand torsion is obtained.

In the above embodiment 1 and embodiment 2, the small-diameter endless frame portions 13S, 18S and the large-diameter endless frame portions 13G, 18G have cup shapes, as an example. However, without limitation thereto, members obtained by filling the inside of the cup-shape structure with an insulating material may be used.

It is noted that, within the scope of the present invention, the above embodiments may be modified or simplified as appropriate.

DESCRIPTION OF THE REFERENCE CHARACTERS

1 gas insulated switchgear
2 switch tank
3 circuit breaker tank
5 compartment bushing
6 circuit breaker
7 switch operation mechanism
8 circuit breaker operation mechanism
9 horizontal bus
10 bus bushing
11*a* ON-side fixed terminal
11*b* ground-side fixed terminal
11*c* compartment-bushing-side fixed terminal
12 switch blade
13 phase-to-phase connection mechanism
13*ab* fitting coupling
13*a* projecting portion
13*b* recessed portion
13*c* blade support portion
13G large-diameter endless frame portion
13S small-diameter endless frame portion
14 connection adapter
15 seal case
16 seal shaft
17 contact pressure spring
17*a* pin
18 phase-to-phase connection mechanism
18*ab* fitting coupling
18*a* projecting portion
18*b* recessed portion
18*c* reinforcing rib
18*d* upper rib
18*e* blade support portion
18*f* inner partition wall
18G large-diameter endless frame portion
18S small-diameter endless frame portion
19 positioning pin
20 switch

The invention claimed is:

1. A switch for gas insulated switchgear, comprising:

a switch blade which is rotatable around a rotation shaft, the switch blade having a fulcrum at an end of the switch blade fixed to the shaft, to cause a contact portion formed at another end thereof to contact with or be separated from a main circuit, thereby performing three-position switching among ON, OFF, and ground of the main circuit, wherein the end of the switch blade fixed to the shaft is in constant contact with a fixed terminal; and phase-to-phase connection mechanisms made of an insulating material and divided for respective phases, each phase-to-phase connection mechanism including:

a blade support portion surrounding and supporting the switch blade such that the contact portion of the switch blade protrudes to outside; and a large-diameter endless frame body and a small-diameter endless frame body which are formed in such shapes as to be fitted to each other, and which are arranged so as to be respectively directed toward one end and the other end in a direction of the rotation shaft, with the blade support portion provided therebetween, wherein the phase-to-phase connection mechanisms for necessary phases are provided along the rotation shaft, and the phase-to-phase connection mechanisms adjacent to each other are connected by a fitting coupling obtained by fitting and coupling the large-diameter endless frame body and the small-diameter endless frame body that are opposed to each other, and wherein each phase-to-phase connection mechanism includes a positioning pin provided to the switch blade, and a protrusion suppressing movement of the switch blade in a longitudinal direction thereof.

2. The switch for gas insulated switchgear according to claim 1, wherein the blade support portion has a box shape and stores and holds the switch blade in the box shape, and a length of the blade support portion in a phase-to-phase direction is set to be greater than a length of a charge portion of the switch blade.

3. The switch for gas insulated switchgear according to claim 1, wherein at least one of the large-diameter endless frame body and the small-diameter endless frame body has a cup shape.

4. The switch for gas insulated switchgear according to claim 1, wherein the fitting coupling is used as a rotation shaft portion between the phase-to-phase connection mechanisms adjacent to each other.

5. The switch for gas insulated switchgear according to claim 1, wherein an inner circumferential portion of the large-diameter endless frame body and an outer circumferential portion of the small-diameter endless frame body are respectively formed of insulating members of which radial-direction cross sections have recess-projection shapes or polygonal shapes.

6. The switch for gas insulated switchgear according to claim 5, wherein recess and projection portions of the large-diameter endless frame body and the small-diameter endless frame body are formed by an equal number of recesses and projections.

7. The switch for gas insulated switchgear according to claim 1, wherein each phase-to-phase connection mechanism includes, at each end of the switch blade, a contact pressure spring applying a contact pressure to the switch blade, and a pin holding the respective contact pressure spring and suppressing movement of the switch blade in a longitudinal direction thereof.

8. The switch for gas insulated switchgear according to claim 1, wherein each phase-to-phase connection mechanism has a function as an insulating barrier for the switch blade among phases and against ground.

9. A gas insulated switching device using the switch for gas insulated switchgear according to claim 1.

* * * * *